US006899043B2

(12) United States Patent
Muessig et al.

(10) Patent No.: US 6,899,043 B2
(45) Date of Patent: May 31, 2005

(54) METHOD AND DEVICE FOR CUTTING AND FOLDING A FABRIC SECTION

(75) Inventors: Karl Muessig, Bad Koenigshofen-Eyershausen (DE); Hans Ziegler, Grossbardorf (DE)

(73) Assignee: TEXPA Maschinenbau GmbH & Co. KG, Saal/saal (DE)

( * ) Notice: Subject to any disclaimer, the term of this patent is extended or adjusted under 35 U.S.C. 154(b) by 154 days.

(21) Appl. No.: 10/317,998

(22) Filed: Dec. 12, 2002

(65) Prior Publication Data

US 2004/0112265 A1 Jun. 17, 2004

(51) Int. Cl.[7] ..... D05B 35/00; D05B 37/04

(52) U.S. Cl. ..... 112/475.06; 112/147

(58) Field of Search ..... 112/470.16, 475.06, 112/475.07, 475.08, 147, 304, 305, 307, 311, 312, 313, 314; 270/32, 39.06, 41, 30.02

(56) References Cited

U.S. PATENT DOCUMENTS 4,607,582 A * 8/1986 Brocklehurst ..... 112/470.06
4,621,585 A * 11/1986 Ball et al. ..... 112/10
4,754,717 A 7/1988 Henze et al.
5,529,005 A * 6/1996 Saotome et al. ..... 112/470.31
5,839,379 A * 11/1998 Freermann ..... 112/10
6,347,596 B1 * 2/2002 Koeberlein et al. ..... 112/141

FOREIGN PATENT DOCUMENTS

WO 9623626 * 8/1996

* cited by examiner

*Primary Examiner*—Ismael Izaguirre
(74) *Attorney, Agent, or Firm*—McGlew and Tuttle, P.C.

(57) ABSTRACT

A method and a device (09) for cutting and folding a fabric section (34) from a continuous material sheeting (01) for producing multilayer casings, in particular pillowcases, having a first gripper (25) that secures and pulls off the front edge (31) of the material sheeting (01) by a first partial amount. A second gripper (26) secures the material sheeting (01) behind the front edge (31) to form a folded edge (33), which can be pulled off by a second partial amount, and at the same time, folded together in multiple layers by movement of the second gripper (26) combined with resetting of the first gripper (25), and a cutting device (27) cuts the material sheeting (01) to form the fabric section (34) the length of which between the front edge (31) and the rear edge (36) corresponds to the sum of the first and second partial amounts.

19 Claims, 6 Drawing Sheets

METHOD AND DEVICE FOR CUTTING AND FOLDING A FABRIC SECTION

BACKGROUND OF THE INVENTION

1. Field of the Invention

Figure 1:
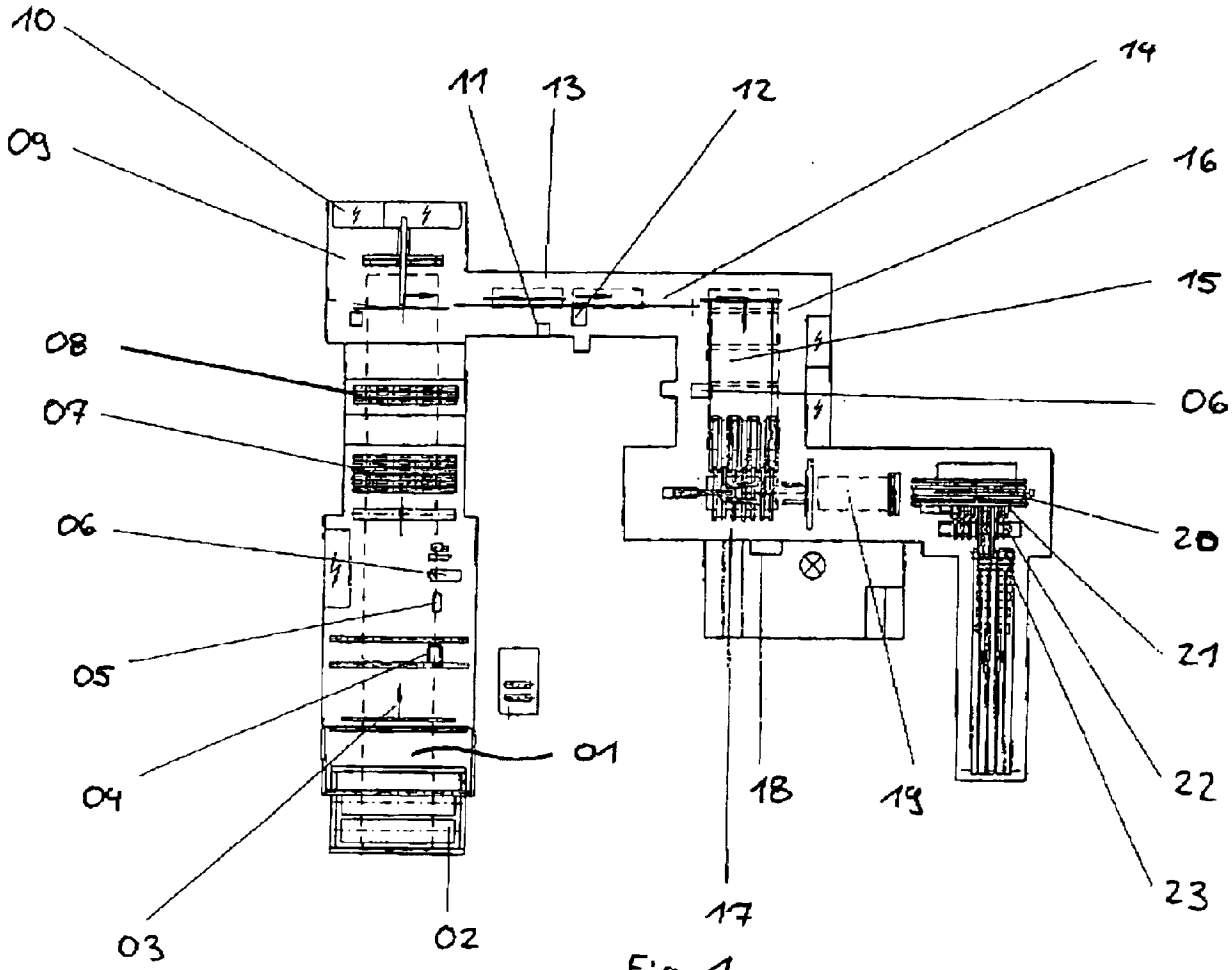

This invention relates to a method and device for cutting and folding a fabric section starting from a continuous material sheeting for producing multilayer casings, in particular pillowcases.

2.Description of the Related Art

U.S. Pat. No. 4,754,717 describes a generic device for cutting and folding a section of fabric. With this device, first the fabric is pulled off in the length required accordingly from a continuous material sheeting in a take-up station and then is cut off by using a cutting station, resulting in a section of fabric of a suitable length. This section of fabric is then conveyed to a downstream folding station where the section of fabric is folded together by using suitable folding equipment to form a multilayer section of fabric. The side edges of the section of fabric are then sewed together in a downstream sewing station to form a sheath or pillowcase that is closed on three sides.

One disadvantage of this known device is that relatively long cycle times are required because of the succession of cutting and folding operations involving the section of fabric.

SUMMARY OF THE INVENTION

The object of the present invention is therefore to propose a method and a device for cutting and folding a section of fabric with which the required cycle times can be reduced.

This object is achieved by a method of cutting and folding a fabric section starting from a continuous material sheeting for producing multilayer casings, in particular pillowcases, characterized in that the front edge of the material sheeting is secured with a first gripper, the material sheeting is pulled off by a first partial amount by movement of the first gripper, the material sheeting is secured with a second gripper behind the front edge, forming a folded edge, the material sheeting is pulled off by a second partial amount by movement of the second gripper and at the same time resetting the first gripper and at the same time it is folded in multiple layers, the material sheeting is cut with a cutting device to form a fabric section the length of which between the front edge and the rear edge corresponds to the sum of the first and second partial amounts.

The object is also achieved by a device for cutting and folding a fabric section starting from a continuous material sheeting for producing multilayer casings, in particular pillowcases, having a first gripper by means of which the front edge of the material sheeting is secured and can be pulled off by a first partial amount by movement of the first gripper, characterized in that a second gripper is provided on the device by means of which the material sheeting can be secured behind the front edge to form a folded edge whereby the material sheeting can be pulled off by a second partial amount and at the same time folded together in multiple layers by the movement of the second gripper and by resetting the first gripper at the same time, and whereby a cutting device is provided on the device for cutting the material sheeting to form the fabric section the length of which between the front edge and the rear edge corresponds to the sum of the first and second partial amounts.

Advantageous embodiments are achieved as follows; It is achieved by the method and device as mentioned above, characterized in that the first gripper is retracted a short distance to release the tension on the material sheeting before and/or during the formation of the folded edge with the second gripper.

It is also achieved by the method and device as mentioned above, characterized in that the length of the first partial amount corresponds to the length of the second partial amount, and the front edge and the rear edge come to lie in alignment one on top of the other after forming the fabric section.

It is further achieved by the method and apparatus as discussed above, characterized in that the position of at least one side edge of the material sheeting is determined in the area of the first front edge by at least one sensor as the first measured value after the front edge has been secured in the first gripper and before the adjustment of the first gripper, at the end of the folding of the material sheeting into multiple layers and before severing the material sheeting, the position of the side edge of the material sheeting is determined as the second measured value by the sensor in the area of the rear edge to be formed, starting from the difference between the first measured value and the second measured value, the first gripper is adjusted across the material sheeting until the side edge of the material sheeting in the area of the rear edge to be formed comes to lie approximately in alignment on the side edge of the material sheeting in the area of the front edge.

It is further achieved by the method and apparatus as discussed above, characterized in that the first gripper is moved vertically upward after pulling off the first partial amount. The method according to one of Claims 1 through 5, characterized in that the second gripper is moved horizontally to the rear after pulling off the second partical amount. It is further achived by the method and device as discussed above, characterized in that the first gripper is opened only after severing the material sheeting so that the front edge of the fabric section falls on the rear edge of the faabric section. It is further achieved by the method and device as described above, characterized in that the first gripper is advanced toward a back stop before severing the material sheeting with fixation of the layers of the material sheeting.

It is further achieved by the method and apparatus as discussed above,characterized in that the first gripper is moved vertically upward after pulling off the first partial amount.

The method according to one of claims 1 through 5, characterized in that the second gripper is moved horizontally to die rear after pulling off the second partial amount.

It is further achieved by the method and device as discussed above, characterized in that the first gripper is opened only after severing the material sheeting so that the front edge of the fabric section falls on the rear edge of the fabric section.

It is further achieved by the method and device as described above, characterized in that the first gripper is advanced toward a back stop before severing the material sheeting with fixation of the layers of the material sheeting.

It is additionally achieved by the method and device as discussed above, characterized in that the fabric section is conveyed further with a transverse conveyor after cutting the material sheeting.

It is further achieved by the method and device as described above, characterized in that before releasing the first gripper the back stop the transverse conveyor is moved toward a table holding the material sheeting while retaining the layers of the material sheeting material.

In addition, the objective is further achieved by the device as described above, characterized in that at least one sensor is provided on the device for determining the position of a side edge of the material sheeting in the area of the front edge and/or in the area of the rear edge to be formed.

It is further achieved by the device as described above, characterized in that the sensor is designed in the manner of a line-scanning camera.

It is further achieved by the device as described above, characterized in that the first gripper can be adjusted across the material sheeting.

It is further achieved by the device as described above, characterized in that the first gripper can be moved vertically between two end positions.

It is further achieved by the device as described above, characterized in that the second gripper can be moved horizontally between two end positions.

It is further achieved by the device as described above, characterized in that the second gripper cooperates with a folding strip in forming the folded edge.

It is further achieved by the device as described above, characterized in that the folding strip has recesses on the side facing the second gripper.

It is further achieved by the device as described above, characterized in that the cutting device is designed in the manner of a cutting wheel, which can be moved alternately between two end positions.

Finally, it is further achieved by the device as described above, characterized in that the device is part of an installation for producing sewed casings, in particular pillowcases.

This invention is based on the fundamental idea that cutting and folding the fabric section is performed in a combined operation to shorten the required process times. This is accomplished according to this invention by the fact that two grippers drivable in different directions are used. With the first gripper, the front edge of the material sheeting is secured first and then by moving the first gripper, the material sheeting is pulled off by a first partial amount. As soon as the first gripper has reached the rear end position, the second gripper is brought to engagement on the material sheeting so that a folded edge is secured in the second gripper downstream from the front edge of the material sheeting.

As soon as the folded edge has been formed by the second gripper, the two grippers are moved toward one another in coordination so that the material sheeting is pulled off by a second partial amount by the traversing movement of the second gripper and at the same time the area of the material sheeting between the front edge and the folded edge is placed on the material sheeting running beneath it by the traversing of the first gripper, thereby folding the material sheeting into several layers. At the end of this traversing movement of the two grippers, the result is a material sheeting laid out in two layers in particular. By using a cutting device, the material sheeting is then cut at the desired rear edge, forming a multilayer section of fabric.

In forming the folded edge, the partial area of the material sheeting pulled off by the first gripper should if possible not be under tension because otherwise the formation of the folded edge is prevented. According to a preferred embodiment, therefore the first gripper is retracted a short distance before and/or during the formation of the folded edge in order to release the tension on the material sheeting.

Essentially any desired design of the section of fabric folded together in multiple layers is possible. However, in the production of many textile materials, it is desirable for the front edge to come to lie on the rear edge as accurately as possible so that these areas may be sewed together cleanly. This design may be achieved by the fact that the length of the first partial amount of the material sheeting corresponds to the length of the second partial amount so that as a result the distance between the front edge and the folded edge corresponds to the distance between the folded edge and the rear edge of the material sheeting.

In addition to the front edge lying in alignment on the rear edge, it is also necessary with most textile materials for the side edges of the two layers to come to lie in alignment after the material sheeting has been folded so that these areas can also be sewed together cleanly. To be able to accomplish this alignment of the side edges of the section of fabric, according to a preferred embodiment, a first gripper, which is adjustable across the material sheeting is used, cooperating with one or more sensors to measure the position of the side edges. This may be accomplished in particular by the fact that after fixation of the front edge in the first gripper and before adjustment of the first gripper, the position of the side edge of the material sheeting in the area of the front edge is determined as the first measured value by using a sensor. In the time range just before the end of the multilayer folding of the material sheeting and before severing the material sheeting, then the position of the side edge of the material sheeting in the area of the rear edge to be formed is determined as the second measured value by the sensor. Starting from these two measured values, it is then possible to calculate whether the two side edges have come to lie in alignment one on top of the other after folding. If this is not the case because the two measured values show a difference, then the gripper which is adjustable across the material sheeting is moved transversally until the side edges of the material sheeting come to lie approximately in alignment one above the other. This adjustment of the first gripper to align the side edge of the material sheeting may be designed in the manner of a control segment or a control loop.

To reliably prevent any unwanted shifting of the layers of the section of fabric placed one above the other in all phases of the process, the layers of material should be secured through appropriate means at all times in the process, if possible. In the phase shortly before severing the section of fabric by the cutting device, this may be accomplished by using the first gripper. To do so, the first gripper is moved toward a back stop to hold the two layers of the material sheeting together.

Before releasing the first gripper from the back stop, the fabric section should then be secured by a transverse conveyer which is moved for this purpose toward a table holding the material sheeting, thereby holding the layers of the fabric section and at the same time conveying the fabric section on to the next station.

One embodiment of this invention is illustrated schematically in the drawings and is explained in greater detail below as an example.

BRIEF DESCRIPTION OF THE DRAWING(S)

Figure 2:
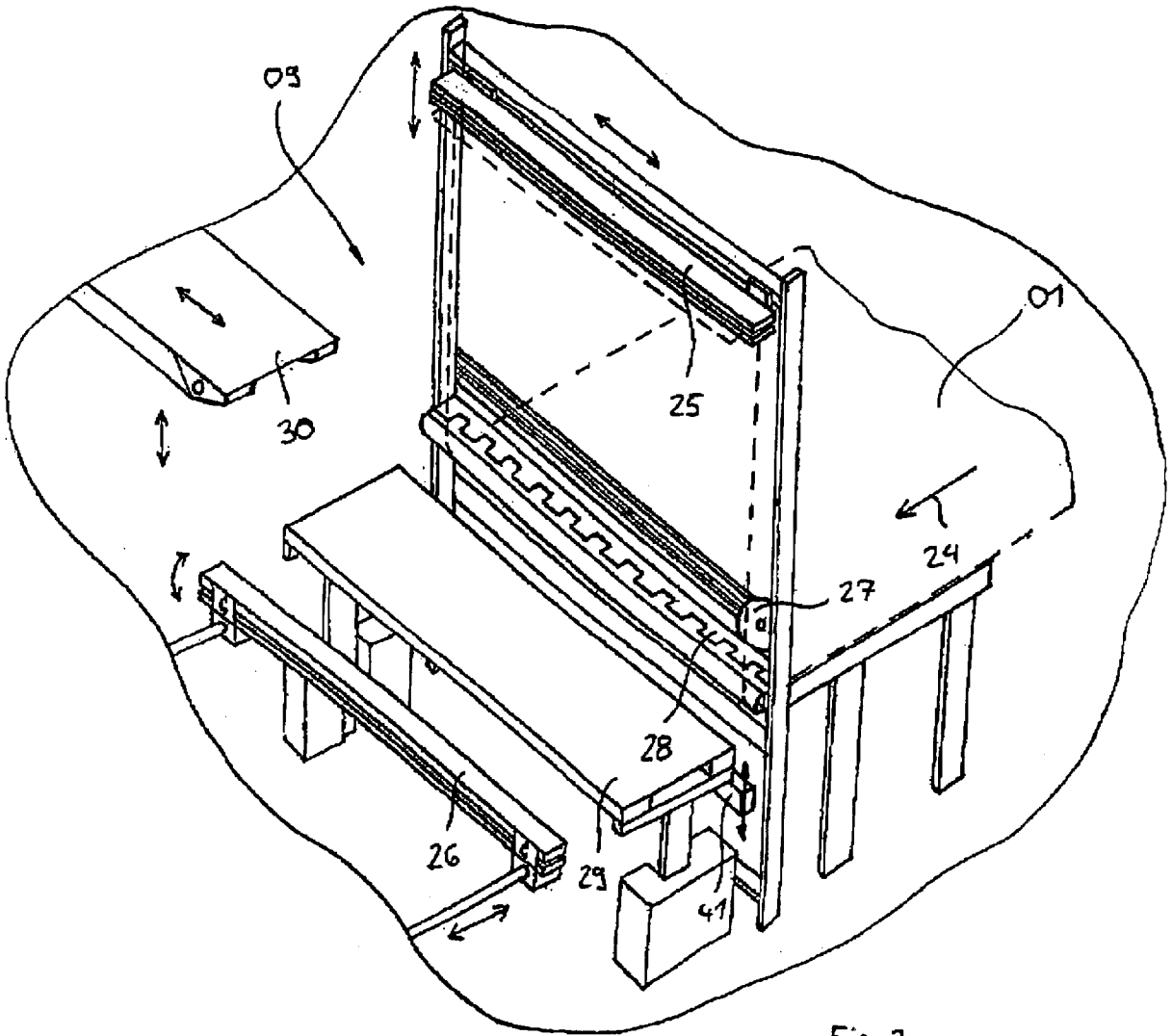
Figure 3:
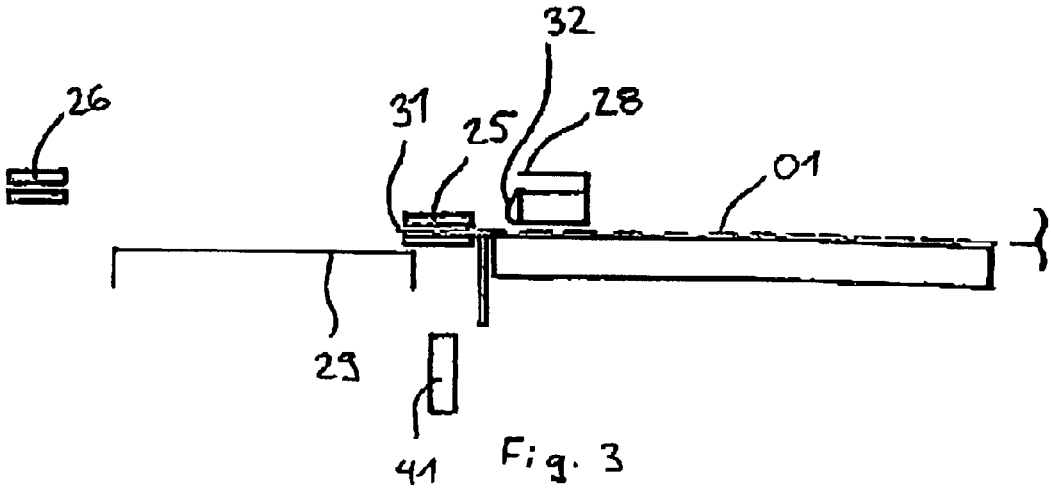
Figure 4:
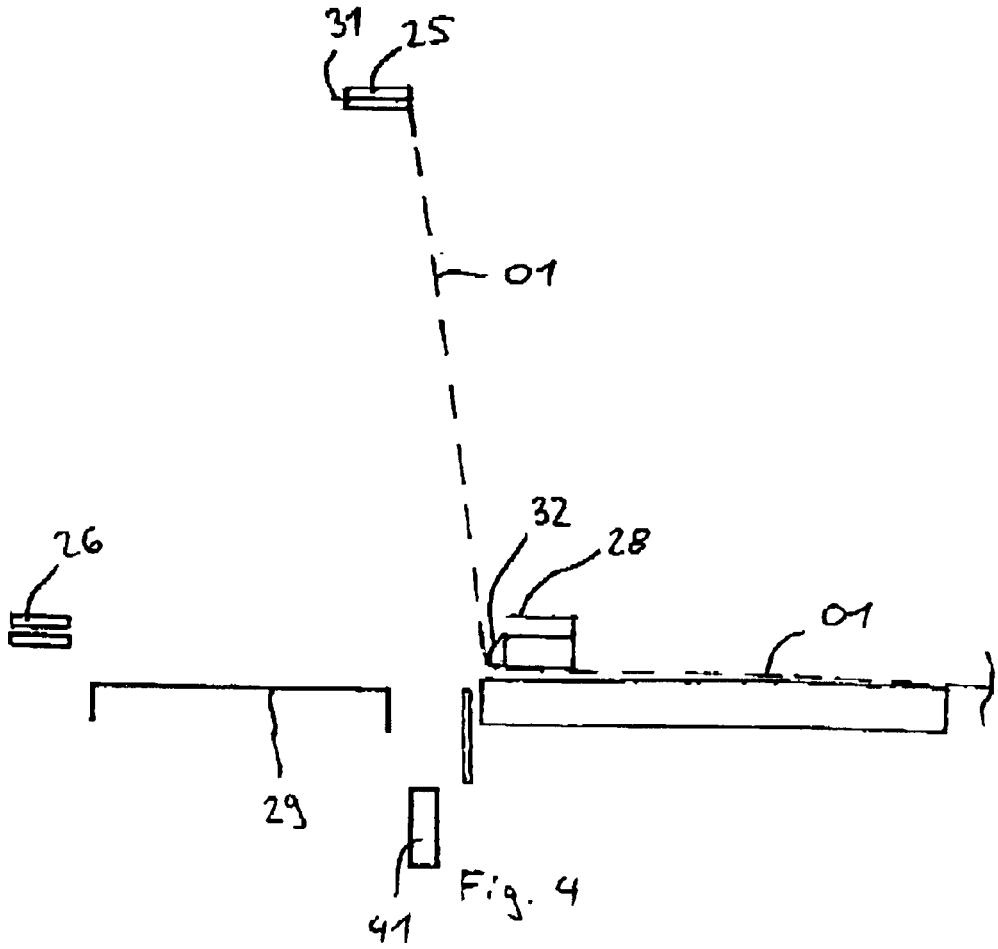
Figure 5:
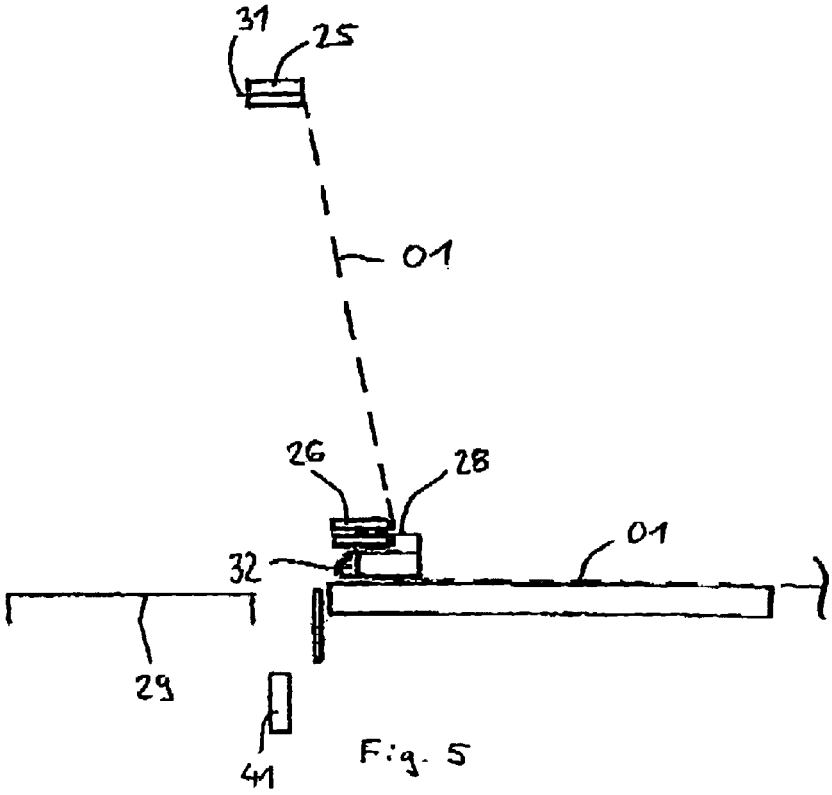
Figure 6:
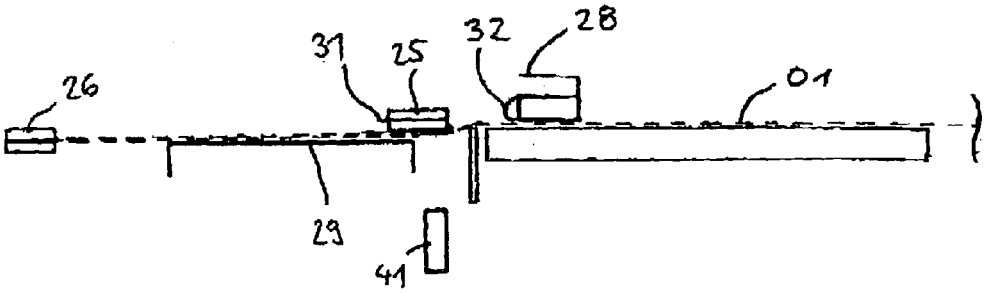
Figure 7:
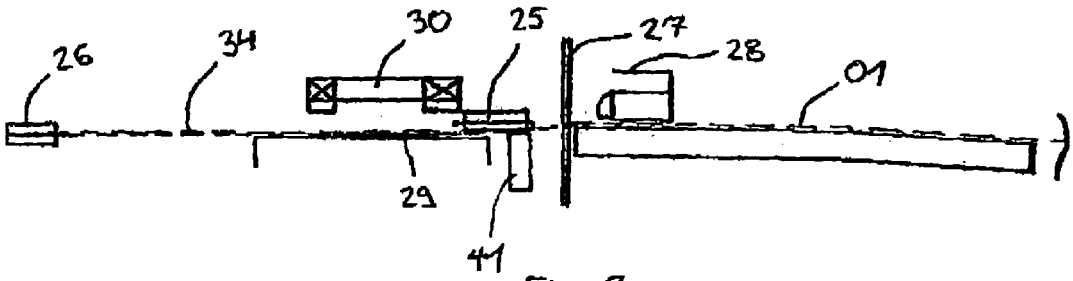
Figure 8:
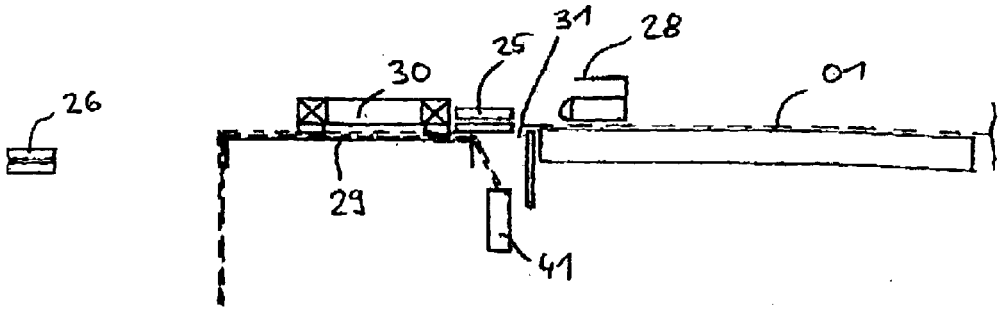
Figure 9:
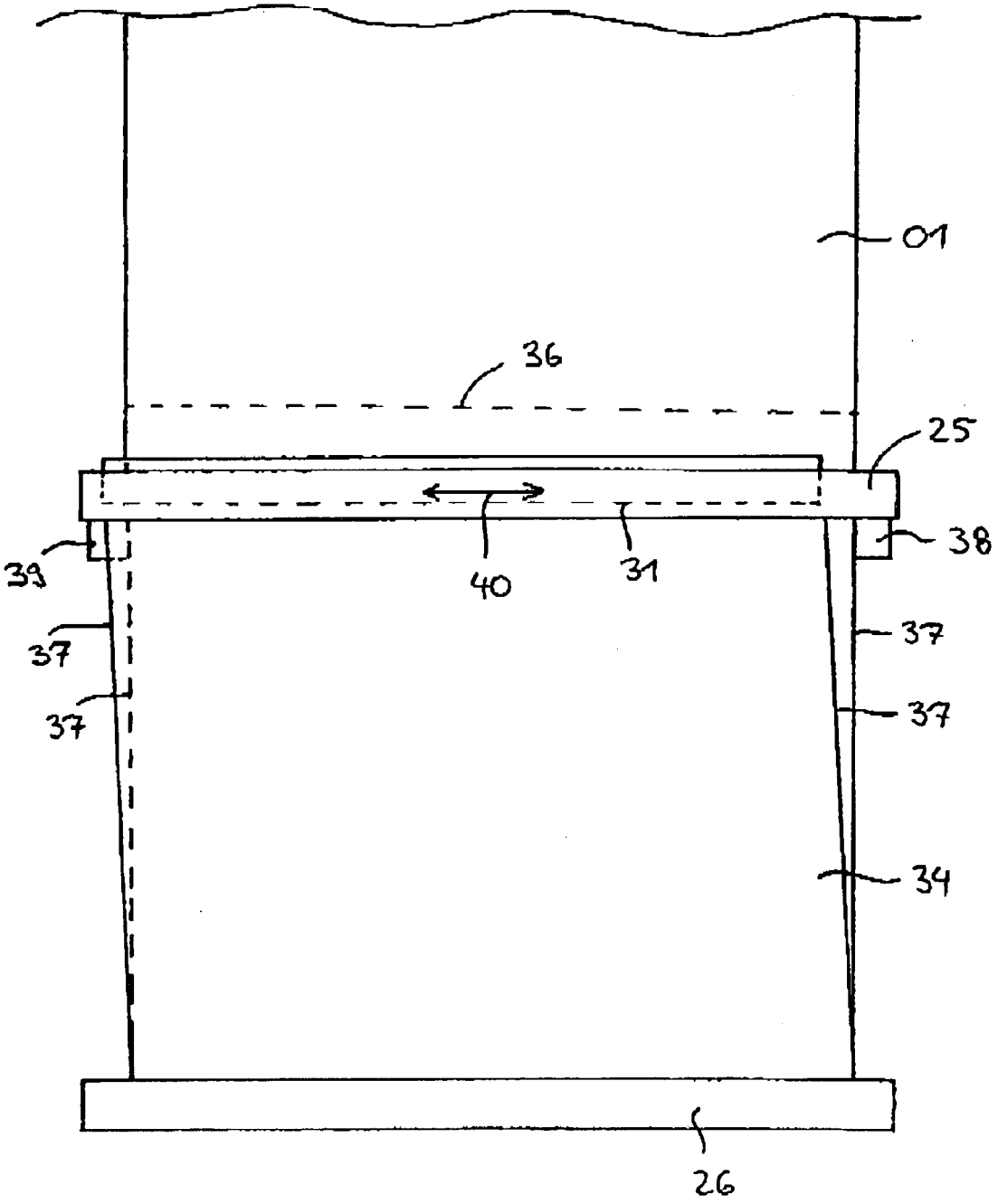

They show:

FIG. 1 an installation for producing sewed coverings, in particular pillowcases, shown in a schematic view from above;

FIG. 2 a device for cutting and folding a fabric section in a schematic perspective view;

FIG. 3 the device according to FIG. 2 during a first process step, shown in cross section;

FIG. 4 the device according to FIG. 3 in a second process step;

FIG. 5 the device according to FIG. 3 in a third process step;

FIG. 6 the device according to FIG. 3 in a fourth process step;

FIG. 7 the device according to FIG. 3 in a fifth process step;

FIG. 8 the device according to FIG. 3 in a sixth process step;

FIG. 9 the device according to FIG. 2 during the process step provided for aligning the side edges, shown in a view from above.

DESCRIPTION OF THE PREFERRED EMBODIMENT(S)

FIG. 1 shows as an example an installation for producing sewed coverings, in particular pillowcases, as shown in a view from above. The starting material for producing the coverings or cases is a material sheeting 01, which is indicated with dotted lines in FIG. 1. The material sheeting 01 is wound up into a roll and is stored in an unwinding device 02. While passing through a lengthwise sewing station 03, the material sheeting is cut by a cutting device 04 on the right side. Then the seam is formed with a seaming device 05 on the right side of the material sheeting 01 as needed, and this seam is then sewed with a first sewing unit 06.

Following this, the material sheeting 01 passes through two material storage devices 07 and 08, where a certain length of the material sheeting is stored to be able to avoid interruptions in production, in particular when changing rolls, when there is a thread break or a similar event. This is followed by a device 09 for cutting and folding fabric sections, which will be explained in greater detail below on the basis of the drawings in FIGS. 2 through 9. Control panels 10 are used to control the device 09.

Labels may be supplied with a label-dispensing device 11 and then also sewed by means of a second sewing unit 12. In addition, a first transverse seam of the folded sections of fabric is sewed using the sewing unit 12. An acceleration station 13 is used to increase the conveyance rate of the individual fabric sections. This first transverse sewing station 14 is followed by a second transverse sewing station 15, where the folded fabric sections are sewed along their one side edge after being accelerated in an acceleration and transfer station 16. After passing through the two transverse sewing stations 14 and 15, the fabric sections, which have been folded together in two layers in the device 09, are sewed together so that the front edge is joined to the rear edge of the fabric section and on one side the superimposed side edges are also joined together securely. Thus, the result is a pillowcase which is open on only one side. This pillowcase is then turned inside out in a turning station 17 so that the seams come to lie on the inside of the pillowcase.

An operating console 18 is used for input of control data. In an inspection station 19, the pillowcases that have been sewed are inspected for quality shortcomings after being turned. Then the pillowcases are folded according to the desired package size in three successive folding stations 20, 21 and 22 and then they are stacked by a stacking device 23.

FIG. 2 shows the device 09 for cutting and folding the fabric sections in a schematic perspective view, showing only the parts of device 09 which are necessary for an understanding of this invention. Coming from the material storage device 08, the material sheeting 01 is conveyed in the direction of the arrow 24.

The device 09 consists essentially of a first gripper 25, which is designed in the manner of a gripping strip, a second gripper 26, which is also designed in the manner of a gripping strip, a cutting device 27 which is designed in the manner of a cutting wheel, a folding strip 28 which has recesses on one side, a table 29 on which the material sheeting 01 can be placed and a back stop 41 which is adjustable in height. A transverse conveyor 30 is provided for conveying the fabric sections 34 further after folding and cutting to length, delivering the fabric sections 34 onto continuously revolving conveyor belts which come from above to come in contact with the folded fabric sections.

The function of the device 09 in folding and cutting the fabric sections starting from the material sheeting 01 is explained below on the basis of the drawings in FIGS. 3 through 9. FIG. 3 shows the first processing step of a cycle for cutting and folding a fabric section 34. Due to the use of suitable conveyor means, the material sheeting 01 (indicated with dotted lines) is introduced at its front edge 31 into the first gripper 25, which has been opened. As soon as the front edge 31 has been inserted deep enough into the gripper 25, the gripper 25 is closed and the front edge 31 of the material sheeting 01 is thereby secured. The length of the section of the material sheeting 01, which is secured in the gripper 25 is to be coordinated with the fact that the material sheeting 01 can be secured reliably in draw-off. In addition, the section in the gripper 25 should be just long enough so that the front edge 31 falls on the rear edge 36 so that they are aligned without any further manipulation after severing the material sheeting 01 and then opening the gripper 25 subsequently (see FIG. 8).

Then the closed gripper 25 is moved vertically out of its lower end position shown in FIG. 3 into its upper end position shown in FIG. 4 so that the material sheeting 01 is pulled off by the corresponding partial amount. In the process, the material sheeting 01 is deflected on a deflecting profile 32 provided on the folding strip 28. As soon as the gripper 25 has reached its upper end position, it is moved downward again a short distance to release the tension on the material sheeting 01.

Then as illustrated in FIG. 5, the second gripper 26 is moved horizontally forward in the opened position until a folded edge 33 is formed (see FIG. 8) by the cooperation of the opened gripping strips of the gripper 26 and the stationary folding strip 28. After forming the folded edge 33, the gripping strips of the gripper 26 are moved together, thereby securing the material sheeting in the area of the recesses on the folding strip 28.

Then as illustrated in FIG. 6, to form a two-layer pillowcase, the gripper 26 is moved horizontally toward the rear and the gripper 25 is moved vertically downward at the same time. Due to the horizontal retraction of the gripper 26, the material sheeting 01 is pulled off by an additional partial amount and at the same time the upper layer of the material sheeting is placed on the lower layer beneath it through the vertical adjustment of the gripper 25.

Following that, as illustrated in FIG. 7, the back stop 41 is moved upward to hold the two layers between the back stop 41 and the underside of the gripper 25 so that the two layers can no longer shift relative to one another. As soon as the two layers are secured in this way, the cutting device 27 is made to engage on the material sheeting 01 to sever the material sheeting 01 and form a two-layer folded fabric section 34. In severing the material sheeting 01, the cutting device 27 cooperates with a lower cutting strip 35. Essentially simultaneously with the cutting of the material sheeting 01, the transverse conveyor 30 is moved laterally into the device 09 so that it can be brought from above into contact with the two-layer folded fabric section 34.

In the next step, as illustrated in FIG. 8, the two-layer folded fabric section 34 is secured between the transverse conveyor 30 and the table 29 by lowering the transverse conveyor 30. The gripper 25 is opened so that the front edge 31 falls in alignment onto the rear edge 36 of the two-layer folded fabric section 34 formed by the cutting operation. After opening the gripper 26, then the fabric section 34 is conveyed further by the drive of the transverse conveyor 30.

FIG. 9 shows the device 09 with the two grippers 25 and 26 in the view as seen from above, where the other parts of the device 09 have not been shown to facilitate an understanding. FIG. 9 shows the flush alignment of the side edges 37, which takes place shortly before severing the material sheeting 01, i.e., approximately at the stage of the process illustrated in FIG. 6. By means of two sensors 38 and 39, the offset between the side edges 37 in the area of the front edge 31 and the rear edge 36 which is to be formed and is indicated with dotted lines in FIG. 9 is measured. The offset has been shown on an exaggerated scale in FIG. 9 for a better understanding. On the basis of the measurement results obtained by the sensors 38 and 39, the first gripper 25 is then moved across the material sheeting 01 in the direction of the arrow 40 until the side edges 37 come to lie in alignment one above the other. The adjusting movement of the gripper 25 across the material sheeting 01 may also be executed in synchronization with the vertical resetting movement.

What is claimed is:

1. A method of cutting and folding a fabric section starting from a continuous material sheeting for producing multilayer casings, wherein the front edge of the material sheeting is secured with a first gripper, the material sheeting is pulled off by a first partial amount by movement of the first gripper, the material sheeting is secured with a second gripper behind the front edge, forming a folded edge, the material sheeting is pulled off by a second partial amount by movement of the second gripper and at the same time resetting the first gripper and at the same time it is folded in multiple layers.

the material sheeting is cut with a cutting device to form a fabric section the length of which between the front edge and the rear edge corresponds to the sum of the first and second partial amounts, wherein the first gripper is retracted a short distance to release the tension on the material sheeting before and/or during the formation of the folded edge with the second gripper.

2. The method according to claim 1, wherein the first gripper is moved vertically upward after pulling off the first partial amount.

3. The method according to claim 1, wherein the second gripper is moved horizontally to the rear after pulling off the second partial amount.

4. The method according to claim 1, wherein the first gripper is opened only after severing the material sheeting so that the front edge of the fabric section falls on the rear edge of the fabric section.

5. The method according to claim 1, wherein the fabric section is conveyed further with a transverse conveyor after cutting the material sheeting.

6. The method according to claim 1, wherein the length of the first partial amount corresponds to the length of the second partial amount, and the front edge and the rear edge come to lie in alignment one on top of the other after forming the fabric section.

7. The method according to claim 6, wherein the position of at least one side edge of the material sheeting is determined in the area of the first front edge by at least one sensor as the first measured value after the front edge has been secured in the first gripper and before the adjustment of the first gripper;

at the end of the folding of the material sheeting into multiple layers and before severing the material sheeting, the position of the side edge of the material sheeting is determined as the second measured value by the sensor in the area of the rear edge to be formed, starting from the difference between the first measured value and the second measured value, the first gripper is adjusted across the material sheeting until the side edge of the material sheeting in the area of the rear edge to be formed comes to lie approximately in alignment on the side edge of the material sheeting in the area of the front edge.

8. The method according to claim 6, wherein the first gripper is advanced toward a back stop before severing the material sheeting with fixation of the layers of the material sheeting.

9. The method according to claim 1, wherein the position of at least one side edge of the material sheeting is determined in the area of the first front edge by at least one sensor as the first measured value after the front edge has been secured in the first gripper and before the adjustment of the first gripper;

at the end of the folding of the material sheeting into multiple layers and before severing the material sheeting, the position of the side edge of the material sheeting is determined as the second measured value by the sensor in the area of the rear edge to be formed, starting from the difference between the first measured value and the second measured value, the first gripper is adjusted across the material sheeting until the side edge of the material sheeting in the area of the rear edge to be formed comes to lie approximately in alignment on the side edge of the material sheeting in the area of the front edge.

10. The method according to claim 9, wherein the first gripper is advanced toward a back stop before severing the material sheeting with fixation of the layers of the material sheeting.

11. The method according to claim 1, wherein the first gripper is advanced toward a back stop before severing the material sheeting with fixation of the layers of the material sheeting.

12. The method according to claim 1, wherein the fabric section is conveyed further with a transverse conveyor after cutting the material sheeting, and before releasing the first gripper from the back stop the transverse conveyor is moved toward a table holding the material sheeting while retaining the layers of the material sheeting material.

13. A device for cutting and folding a fabric section starting from a continuous material sheeting for producing multilayer casings, having a first gripper by means of which the front edge of the material sheeting is secured and can be pulled off by a first partial amount by movement of the first gripper, wherein a second gripper is provided on the device by means of which the material sheeting can be secured behind the front edge to form a folded edge whereby the material sheeting can be pulled off by a second partial amount and at the same time folded together in multiple layers by the movement of the second gripper and by resetting the first gripper at the same time, and whereby a cutting device is provided on the device for cutting the material sheeting to form the fabric section the length of which between the front edge and the rear edge corresponds to the sum of the first and second partial amounts, and at least one sensor is provided on the device for determining the position of a side edge of the material sheeting in the area of the front edge and/or in the area of the rear edge to be formed and the sensor is designed in the manner of a line-scanning camera, wherein the first gripper can be adjusted across the material sheeting.

14. The device according to claim 13, wherein the second gripper cooperates with a folding strip in forming the folded edge and the folding strip has recesses on the side facing the second gripper.

15. The device according to claim 13, wherein the first gripper can be moved vertically between two end positions.

16. The device according to claim 13, wherein the second gripper can be moved horizontally between two end positions.

17. The device according to claim 13, wherein the second gripper cooperates with a folding strip in forming the folded edge.

18. The device according to claim 13, wherein the cutting device is designed in the manner of a cutting wheel, which can be moved alternately between two end positions.

19. The device according to claim 13, wherein the device is part of an installation for producing sewed casings.

* * * * *